United States Patent [19]

Knittel

[11] Patent Number: 5,010,696

[45] Date of Patent: Apr. 30, 1991

[54] ROOF GUTTER ATTACHMENT

[76] Inventor: Richard D. Knittel, R. 4, Pinckard Pike, Versailles, Ky. 40383

[21] Appl. No.: 565,932

[22] Filed: Aug. 13, 1990

[51] Int. Cl.[5] ..... E04D 13/00

[52] U.S. Cl. ..... 52/12; 52/11; 210/475; 210/474

[58] Field of Search ..... 52/12, 11; 210/474, 210/475

[56] References Cited

U.S. PATENT DOCUMENTS

| | | | |
|---|---|---|---|
| 901,526 | 10/1908 | Dixon | 210/474 |
| 2,271,081 | 1/1942 | Layton | 210/474 |
| 2,288,121 | 6/1942 | Cisar et al. | 52/12 |
| 4,351,134 | 9/1982 | Clarkson | 52/12 |
| 4,937,986 | 7/1990 | Way, Sr. et al. | 52/12 |

*Primary Examiner*—Richard E. Chilcot, Jr.
*Assistant Examiner*—Joanne C. Downs
*Attorney, Agent, or Firm*—Warren D. Flackbert

[57] ABSTRACT

A roof gutter attachment which overlies a roof gutter to prevent gutter and/or downspout clogging due to the undue or unwanted accumulation of debris. The arrangement presents a pattern of downwardly inclined parallel steps presenting grooves oriented in the path of liquid flow increasing liquid area expanse and the passage of smaller sized debris by reason of liquid adhesion. Linear ridges are defined between each of the grooves, such serving for ready sliding movement of larger sized debris over the gutter and into a receiving area therebelow. Air pressure differential creates a self-cleaning attachment when wind moves across the attachment.

13 Claims, 1 Drawing Sheet

ROOF GUTTER ATTACHMENT

BACKGROUND OF THE INVENTION

As is known, most buildings and/or structures including a sloped roof present guttering at the lower edge region thereof for receiving runoff liquid/water due to, for example, rain and/or snow. A problem occasioned by the preceding is the build-up of foreign matter, such as leaves, twigs and the like, in the area of the eaves, preventing and/or minimizing water flow through the provided drain-off system, and resulting in clogging.

Efforts to maintain a free flow of water have typically included the use of independent wire mesh/screen segments for preventing unwanted debris buildup and/or accumulation within the gutter, and/or the employment of a wire grid plug adapter to be inserted into the opening for a downspout. Each of these typical procedures prove objectionable because of the tendency of foreign matter accumulation to continue, i.e. to buildup on the grid surface and/or to hinder water passage to drain.

DESCRIPTION OF THE INVENTION

The invention presents a roof gutter attachment which, because of surface configuration and capillary action between descending steps thereof, permits more water area coverage and simultaneous leaf/debris passage in a skimming relationship and, ultimately, onto the ground and/or surface beneath the gutter. The instant gutter configuration includes a series of lateral slots, arranged, i.e. staggered, to interrupt all water flow, so that the latter passes into the gutter and down the drainpipe/downspout for ultimate disposition.

The attachment herein is readily secured to the roof structure adjacent the gutter, as by tacking, and includes a lower end which is also secured into position, but, in this instance, onto the front lower lip of the gutter. The invention may be fabricated from malleable rubber or plastic, where some flexibility is desired to aid in both installation and in transporting a quantity of the material to a use site.

Particular significance lies in the fact that channels and/or passageways are provided for water flow and the aforesaid debris skimming, presenting a curvature normal to the direction of water flow which serves multi-purposes, i.e. as a linear vehicle for passing certain of the aforesaid debris and, as well, a shape conducive to maximum water area to elongated outlet slots.

DESCRIPTION OF THE FIGURES

In any event, a better understanding of the present invention will become more apparent from the following description, taken in conjunction with the accompanying drawing, wherein.

Figure 1:
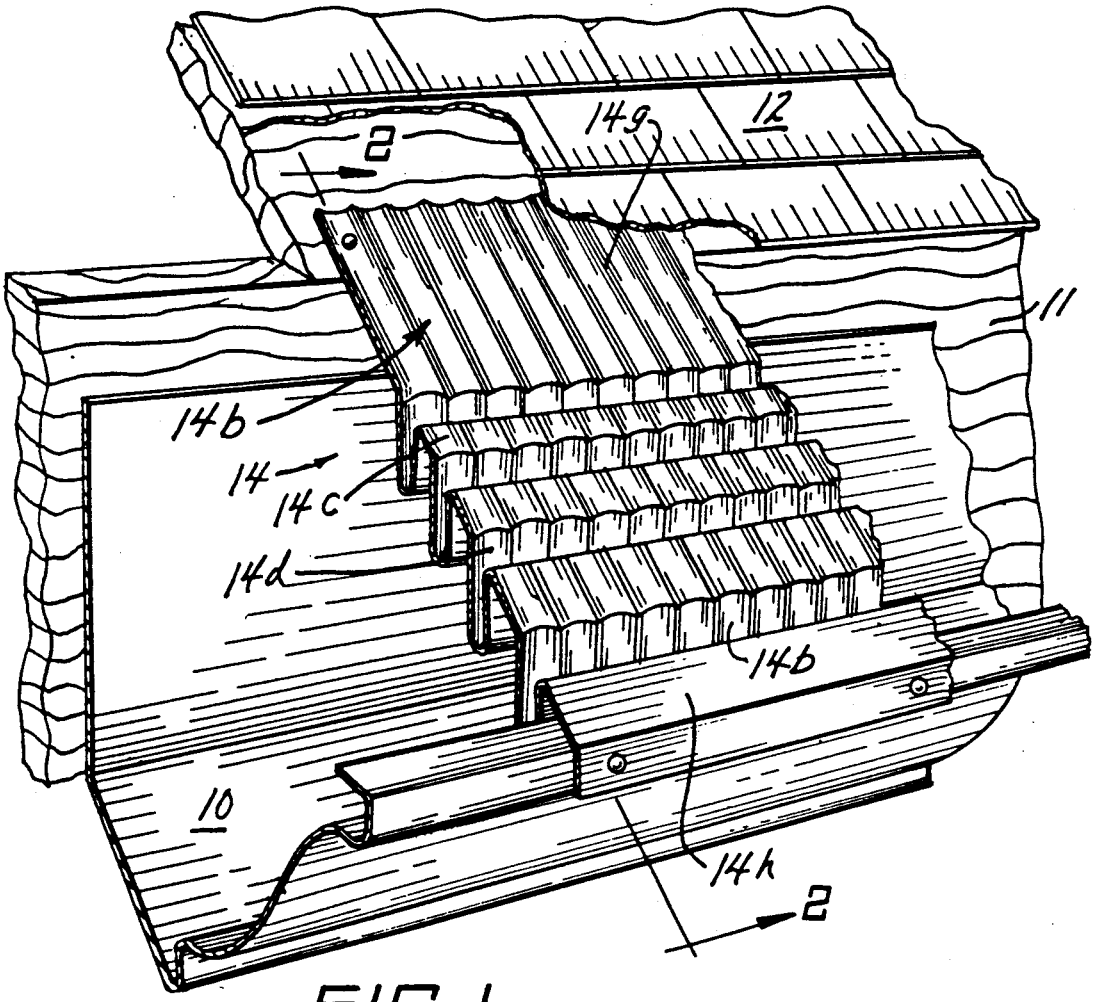
FIG. 1 is a perspective view showing a roof gutter attachment in accordance with the teachings of the present at an installed condition.

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Referring now to the figures, the instant roof gutter attachment 14 is shown in connection with a gutter 10 partially secured beneath roofing 12, where a series of gutter bolts (not shown) secure the gutter 10 to a frame member 11 of the building structure.

The attachment 14 of the invention is in the form of flexible or semi-rigid material, such as hard rubber or even semi-flexible molded plastic resin, presenting a series of operational steps **14*a* extending from the rear to the front of the gutter 10 in a descending relationship. The actual number of operational steps 14*a* is largely dependent upon gutter 10** geometry, i.e. the distance from the rear to the front thereof and any preference in size.

The significance of the invention lies in the use of shallow grooves or passageways **14*b*, in a side-by-side relationship, extending downwardly or forwardly in the direction of water/liquid passage. The grooves 14*b*** may each be considered equivalent to a longitudinally halved common soda straw, where, importantly, water surface area increases as does surface adhesion, playing importance in the practice of the invention.

Figure 2:
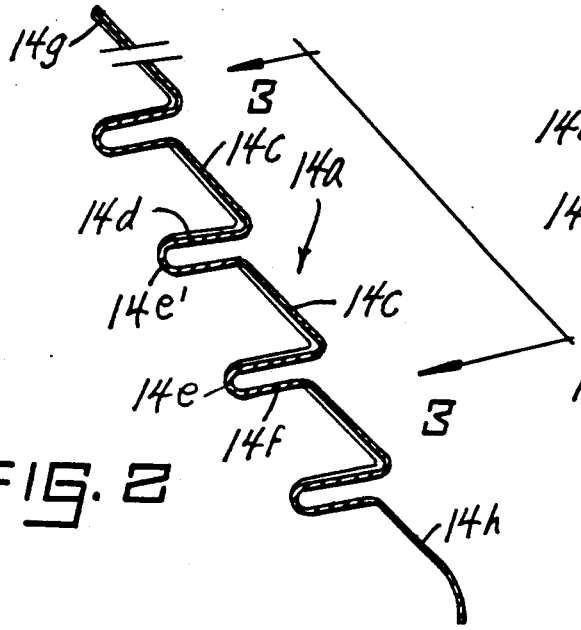
FIG. 2 is a view in side elevation, taken at line 2—2 on FIG. 1 and looking in the direction of the arrows, detailing the configuration of the instant attachment; and, FIG. 3 is another view in elevation, taken at line 3—3 on FIG. 2 and looking in the direction of the arrows, still further detailing the invention, particularly with respect to elongated water slot placement.

Steps **14*a* of the gutter attachment 14 are particularly evident in FIGS. 1 and 2, where each are successively and downwardly defined by a series of inclined surfaces 14*c* each separated by a pocket or fold represented by an inwardly directed surface 14*d*, a curved end 14*e* and an outwardly directed surface 14*f*. Each of the curved bottoms 14*e* includes elongated spaced apart slots 14*e'* (where one row thereof is staggered with respect to the next adjacent rows—see FIG. 3). In other words, with downward water flow, it is impossible for water to avoid all slots 14*e'***.

Figure 3:
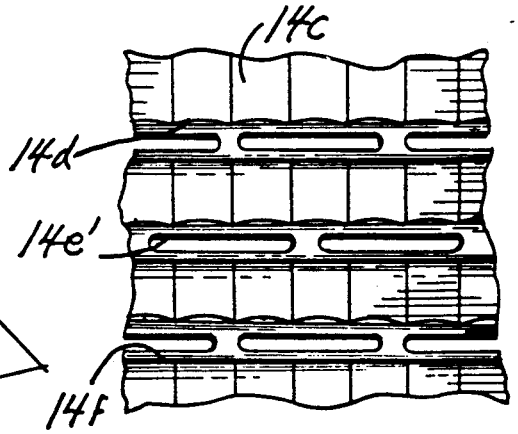

As further apparent in FIGS. 1 and 3, the aforesaid longitudinal grooves **14*b* are present on surfaces 14*c* of the attachment 14, as well as on surfaces 14*d*. The water surface adhesion (combining with that of the next upper surface) permits ready water passage, including small sized debris, to and through a slot 14*e'***.

Typically, the most upper or tacked surface **14*g* of the attachment 14 includes longitudinal grooves 14*b*, where the lowermost tacked surface 14*h* is not channeled nor are surfaces 14*f* making up the remainder of the pockets (see FIG. 2**).

Larger sized debris, carried by air flow, readily moves from step to step and, ultimately, to a position beneath the gutter 10. Actually, the linear or upstanding edge type juncture between adjacent grooves **14*b* presents a vehicle for debris movement, i.e. along a series of defined parallel lines (peaks) in contrast to a flat surface. In other words, larger sized debris is more readily passed over the gutter 10 in a sliding action on the ridge lines (presented by the grooves 14*b*), while water passes beneath the larger sized debris in the grooves 14*b***.

As should be evident from the preceding, therefore, the gutter attachment of the invention serves operational improvements due to the larger expanse of water available for small sized debris passage and the fact that larger sized debris is slidable along the ridge lines defining the common edge between adjacent grooves.

The overflow water readily passes into the pockets, between the steps, provided by the attachment, and slots available for water discharge into the gutter and the avoidance of clogging. On the other hand, larger sized debris is readily movable along the surfaces of the attachment (at the peaks or linear ridge lines), and downwardly along the gutter attachment for release onto the ground or whatever.

As particularly evident in FIG. 2, the steps and/or the surfaces between pockets aid in creating a natural path for debris passage due to the geometry of such, i.e. each surface and/or step is below and behind that of the next preceding upper surface and/or step. Restated otherwise, the steps are arranged in a parallel downward sloping pattern interrupted by inward and downward sloping pockets. Air or wind moving across the parallel steps creates reduced air pressure relative to the static air pressure below the attachment inside the gutter. The resulting differential pressure causes an upward flow of air which removes debris remaining within the pockets.

The gutter attachment described above is susceptible to various changes within the spirit of the invention, including, by way of example, in proportioning; the manner of placement of the gutter attachment in the eave region; the shape of the receiving pocket defining each of the steps; the type of material employed; and, the like. Thus, the preceding should be considered illustrative and not as limiting the scope of the following claims:

I claim:

1. An attachment for a gutter positioned in the eave region of a building comprising a body overlying said gutter at an operative position, said body presenting a series of generally parallel horizontal steps angling in a downward direction in a pattern encouraging liquid flow to an outlet in said gutter, said steps each separated by a receiving pocket, and where said receiving pocket includes outlet means for liquid discharge into said gutter.

2. The attachment of claim 1 where said outlet means is a slot.

3. The attachment of claim 2 where said slot is elongated.

4. The attachment of claim 2 where a plurality of said slots are in rows staggered one with respect to another.

5. The attachment of claim 1 where said body presents a series of grooves oriented in the direction of liquid flow.

6. The attachment of claim 5 where said grooves serve increased liquid adhesion.

7. The attachment of claim 5 where said grooves are disposed on surfaces presented by said steps.

8. The attachment of claim 5 where adjacent grooves present a linear ridge serving the passage of debris in a sliding relationship.

9. The attachment of claim 4 where the pattern of said rows avoids any uninterrupted liquid flow.

10. The attachment of claim 1 where each receiving pocket defined by said steps includes spaced-apart walls blending into an inner wall, and where said inner wall receives said outlet means.

11. The attachment of claim 5 where said grooves serve to increase surface area.

12. The attachment of claim 1 where the relationship of said steps and pockets creates an upward movement of air and debris cleaning action upon wind movement across the attachment.

13. The attachment of claim 1 where liquid surface adhesion carries selective sized debris through said outlet means and into said gutter.

* * * * *